US007369059B2

(12) United States Patent
Hoffmann et al.

(10) Patent No.: US 7,369,059 B2
(45) Date of Patent: May 6, 2008

(54) ELECTRICAL APPARATUS HAVING STATUS INDICATING MEANS

(75) Inventors: Andreas Hoffmann, Lemgo (DE); Andreas Muhs, Borgentreich (DE); Hermann Krause, Detmold (DE); Jürgen Ziemke, Detmold (DE); Klaus Püschner, Detmold (DE); Michael Schnatwinkel, Herford (DE); Ralf Schumacher, Lemgo (DE); Stefan Reker, Bielefeld (DE); Stefan Schumann, Harsewinkel (DE); Ulrike Klasing, Lemgo (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 334 days.

(21) Appl. No.: 11/292,678

(22) Filed: Dec. 2, 2005

(65) Prior Publication Data

US 2007/0040698 A1 Feb. 22, 2007

(30) Foreign Application Priority Data

Dec. 4, 2004 (DE) ..... 20 2004 018 756 U

(51) Int. Cl.
*G08B 5/22* (2006.01)

(52) U.S. Cl. ..... 340/815.45; 340/815.73; 340/654; 307/116

(58) Field of Classification Search ..... 340/654, 340/656, 815.42, 815.47, 815.53, 815.55, 340/815.73; 361/737, 736; 362/20; 307/116
See application file for complete search history.

(56) References Cited

U.S. PATENT DOCUMENTS

| | | | | |
|---|---|---|---|---|
| 6,812,593 | B1 * | 11/2004 | Fisher et al. | 307/116 |
| 7,008,240 | B1 * | 3/2006 | Wang et al. | 439/76.1 |
| 2003/0107497 | A1 * | 6/2003 | Krenz et al. | 340/815.4 |
| 2003/0201676 | A1 * | 10/2003 | Su | 307/149 |
| 2005/0047030 | A1 * | 3/2005 | Lee | 361/1 |
| 2005/0157451 | A1 * | 7/2005 | Kuo | 361/622 |

* cited by examiner

*Primary Examiner*—Benjamin C. Lee
*Assistant Examiner*—Hoi C. Lau
(74) *Attorney, Agent, or Firm*—Lawrence E Laubscher, Sr.; Lawrence E Laubscher, Jr.

(57) ABSTRACT

An electrical power distribution device such as a junction box or the like includes a status indicator that also serves not only to indicate the status of energization of a connector mounted in a first housing opening, but also to illuminate a translucent indicia-bearing plate mounted in second housing opening. The housing contains a chamber in which are mounted a light emitting diode that is energized simultaneously with the connector, and a light transmitting member that directs the light produced by the LED toward the second housing opening.

9 Claims, 1 Drawing Sheet

ELECTRICAL APPARATUS HAVING STATUS INDICATING MEANS

BACKGROUND OF THE INVENTION

1. Field of the Invention

An electrical power distribution device such as a junction box or the like includes a status indicator that also serves not only to indicate the status of energization of a connector mounted in a first housing opening, but also to illuminate a translucent indicia-bearing plate mounted in second housing opening. The housing contains a chamber in which are mounted a light emitting diode that is energized simultaneously with the connector, and a light transmitting member that directs the light produced by the LED toward the second housing opening.

2. Description of Related Art

It is well known in the prior art to provide status indicating means on electrical power distribution devices such as junction boxes, switchgear, relays, actuators, sensors and the like, particularly when the devices are part of a system having remotely located components, such as, for example, the automated electrical distribution and temperature control systems for large office buildings. In the SAI-type electrical power distribution devices, light emitting diodes (LEDs) have been used to indicate optically the state of energization of the devices, sometimes with the use of characterizing colors, such as red, yellow or green.

In addition to the known status indicating means, it has proven desirable to also specifically identify the various devices in some manner, such as by a name plate or other indicia-bearing means. In order to facilitate the reading of the indicia, in accordance with the present invention it is proposed to illuminate an indicia-bearing translucent plate with a portion of the light energy that is developed by the status indicating means. Thus, not only is the indicia-bearing plate illuminated, but also a portion of the generated light (possibly of a given characterizing color such as red, yellow or green), is directly observed as a status indicator.

SUMMARY OF THE INVENTION

Accordingly, a primary of the present invention is to provide an electrical power distribution device in which a light source is energized simultaneously with the electrical connector, and a first portion of the generated light is used to illuminate an indicia-bearing plate, and a second portion is used to indicate the status of the device.

According to a more specific object of the invention, the power distribution device includes a housing formed of insulating material and containing a chamber in which is mounted a light emitting means that is simultaneously energized with a connector mounted within a housing wall opening. Light conducting means transmit this generated light toward a second housing opening that partially receives a translucent indicia-bearing plate that is illuminated by the transmitted light energy. The remaining portion of the second housing opening provides access for the direct viewing of the light conducting member within the chamber, thereby to indicate the status of the connector.

According to a further object of the invention, the housing include a removable bottom wall that carries the light source and contact leads of the connector. In the preferred embodiment, this bottom wall comprises a printed circuit board having a conductor that connects the light source for simultaneous energization with the connector contacts.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
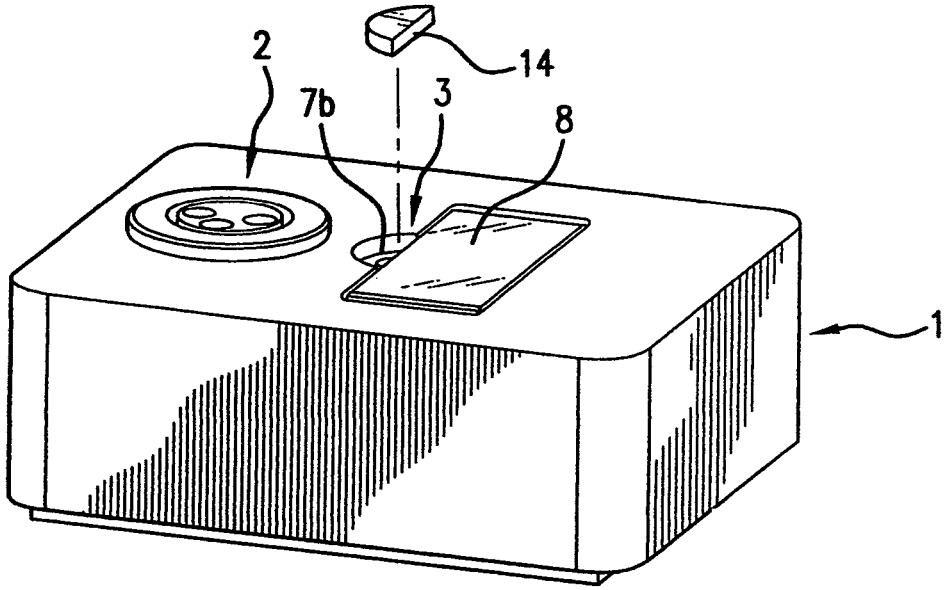
FIG. 1*a* is a perspective view of the power distribution device of the present invention.
Figure 1B:
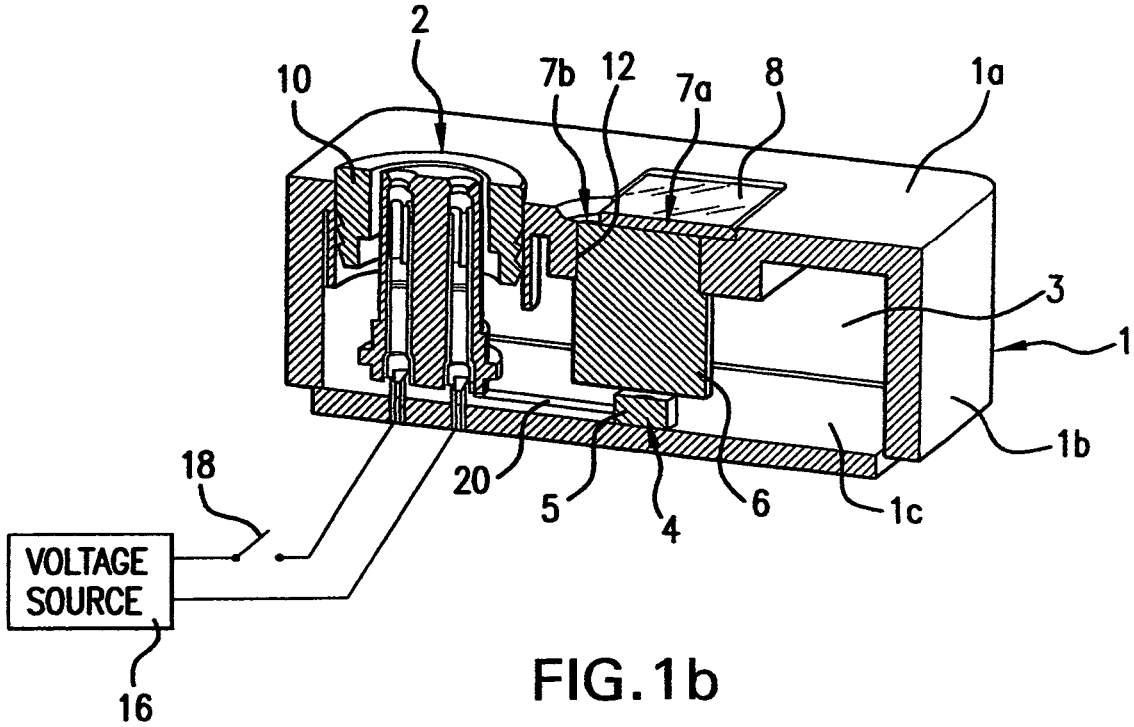
FIG. 1*b* is a sectional view of the apparatus of FIG. 1*a*.

Referring first more particularly to FIG. 1*a*, the electrical power distribution apparatus of the present invention is illustrated in connection with a junction box 1 having a female plug connector 2 provided with status indicator means 3. As shown in FIG. 1*b*, the housing 1 contains a central chamber 3, and includes a top wall 1*a*, a plurality of side walls 1*b*, and a removable bottom wall 1*c* that is connected with the side walls 1*b* by a snap fit connection or the like. The top wall 1*a* contains a first opening 10 in which is mounted the female plug connector 2. The top wall 1*a* also contains a second opening 12 that is partially filled by a translucent indicia-bearing plate 8. The remaining portion of the second opening 12 is adapted to receive a transparent protective plate 14, as will be described below.

The bottom wall 1*c* contains a plurality of openings that receive the contact leads 2*a* of the plug connector 2, which contacts are connected with a voltage source 16 via conductor means containing a switch 18. Also mounted on the housing bottom wall 1*c* is a light source 4 which, in the illustrated embodiment, is a light emitting diode (LED) 5 that is connected with the contacts 2*a* by means of a conductor 20. In the preferred embodiment, the bottom wall 1*c* comprises a printed circuit upon which the light emitting diode is mounted, and the conductor 20 comprises a printed circuit conductor leading to the contact leads 2*a* of the connector 2.

Mounted in the chamber 3 in the opening 12 above the light source 4 is a light conducting member 6, which in the illustrated embodiment comprises a planar rectangular member having an upper edge a first part 7*a* of which extends beneath the translucent indicia-bearing plate 8. The remaining upper part 7*b* of the light conducting member 6 extends beneath the remaining portion of the second opening 12 within which the transparent plate 14 is mounted.

In operation, assume that the switch 18 is closed to energize the contact leads 2*a* of the plug connector 2 from the voltage source 16. Simultaneously, the light emitting diode 5 is energized via the conductor 20 on the printed circuit board that defines the bottom wall 1*c* of the junction box housing 1. Light energy from the LED 5 is transmitted by the light conducting member 6 upwardly toward the second opening 12. A first portion of the generated light is transmitted by the edge portion 7*a* to illuminate the indicia-bearing plate 8, and a second portion of the transmitted light extends from the edge portion 7*b* via the remaining portion of the second opening 12. Thus, the first portion of the emitted light from the light source 4 illuminates the translucent indicia-bearing plate 8, and a second portioned of the emitted light may be viewed directly from the edge 7*b* of the light conducting member 6 via the remaining portion of the second opening 12. If desired, the light conducting 6, the translucent plate 8, and/or the transparent plate 14 may be provided with means producing a distinctive color, such as red, yellow, or green.

If the transparent plate 14 were to be omitted, the status light would be viewed directly from the edge part 7*b* of the light conducting member 6 via the opening defined by the remaining portion of the second opening 12.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical power supply device, comprising a junction box, having status indicating means, comprising:

(a) a housing (1) formed of insulating material, said housing containing a chamber (3) and at least two openings (10, 12) communicating with said chamber;

(b) an electrical connector (2) mounted in a first one of said housing openings, said connector being adapted for connection to a voltage source for operation between energized and de-energized states;

(c) display means including a translucent indicia-bearing plate (8) mounted in a first portion of the second one of said housing openings; and (d) status indicating means for indicting the state of energization of said connector, including:

(1) light emitting means (5) mounted in said chamber, said light emitting means being electrically connected with said connector for simultaneous energization therewith, thereby to generate light energy;

(2) light conducting means (6) mounted in said chamber, said light conducting means having a first end adjacent said light emitting means, and a second end adjacent said second housing opening, thereby to direct said light energy from said light emitting means toward said second housing opening, said second end of said light conducting member having a first end part (7*a*) extending below said indicia-bearing plate, and a second end part (7*b*) extending below said remaining portion of said second opening, whereby a first portion of said light energy serves to illuminate said indicia-bearing plate, and a second portion of the light energy may be viewed directly via said remaining portion of said second opening.

2. An electrical power supply device as defined in claim 1, and further including a transparent plate (14) mounted in said remaining portion of said second opening.

3. An electrical power supply device as defined in claim 1, wherein said connector comprises a plug connector (2).

4. An electrical power supply device as defined in claim 3, wherein said housing includes a plurality of walls one of which contains said first and second openings.

5. An electrical power supply device as defined in claim 4, wherein said housing includes top, side and bottom walls, said housing one wall being said top wall; and further wherein said bottom wall is removable, said light emitting means comprising a light emitting diode supported by said bottom wall, and said light conducting means comprising a light conducting member supported by said top wall.

6. An electrical power supply device as defined in claim 5, wherein said connector includes contacts extending through openings contained in said bottom wall for connection with the voltage source.

7. An electrical power supply device as defined in claim 6, wherein said connector comprises a female plug connector.

8. An electrical power supply device as defined in claim 1, wherein at least one of said light emitting means, said light conducting means, and said indicia-bearing plate produces light of a given color.

9. An electrical power supply device as defined in claim 1, wherein said second end part (7*b*) of said light conducting means is less than 50% of said first end part (7*a*).

* * * * *